US009022818B2

(12) United States Patent
Onuma et al.

(10) Patent No.: US 9,022,818 B2
(45) Date of Patent: May 5, 2015

(54) CRIMP TERMINAL

(75) Inventors: Masanori Onuma, Makinohara (JP); Kousuke Takemura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 124 days.

(21) Appl. No.: 13/814,153

(22) PCT Filed: Aug. 3, 2011

(86) PCT No.: PCT/JP2011/067781
§ 371 (c)(1),
(2), (4) Date: Feb. 4, 2013

(87) PCT Pub. No.: WO2012/018050
PCT Pub. Date: Feb. 9, 2012

(65) Prior Publication Data
US 2013/0130570 A1 May 23, 2013

(30) Foreign Application Priority Data
Aug. 5, 2010 (JP) ..... 2010-175997

(51) Int. Cl.
*H01R 4/18* (2006.01)

(52) U.S. Cl.
CPC ..... *H01R 4/188* (2013.01); *H01R 4/185* (2013.01)

(58) Field of Classification Search
CPC ..... H01R 4/185; H01R 4/188; H01R 43/16; H01R 4/184; H01R 4/203
USPC ..... 439/877–879
See application file for complete search history.

(56) References Cited

U.S. PATENT DOCUMENTS

| | | | | |
|---|---|---|---|---|
| 3,831,132 | A * | 8/1974 | Bowden et al. | 439/442 |
| 3,892,459 | A | 7/1975 | Dittmann et al. | |
| 4,003,623 | A | 1/1977 | Reynolds | |
| 7,364,479 | B1 * | 4/2008 | Deily | 439/879 |
| 8,070,536 | B2 * | 12/2011 | Ono et al. | 439/877 |
| 8,210,884 | B2 * | 7/2012 | Corman et al. | 439/877 |
| 8,221,171 | B2 * | 7/2012 | Ono et al. | 439/877 |
| 2010/0230160 | A1 | 9/2010 | Ono et al. | |
| 2010/0261391 | A1 * | 10/2010 | Ono et al. | 439/877 |
| 2011/0124247 | A1 * | 5/2011 | Okamura et al. | 439/877 |

FOREIGN PATENT DOCUMENTS

| | | | |
|---|---|---|---|
| CN | 101740880 | A | 6/2010 |
| EP | 2 602 876 | A1 | 6/2013 |
| JP | S55-096575 | | 7/1980 |
| JP | 55-108192 | A | 8/1980 |
| JP | 5842951 | B2 | 9/1983 |

(Continued)

OTHER PUBLICATIONS

Japanese Office Action issued Jul. 17, 2014 in counterpart Japanese patent application No. 2010-175997.

(Continued)

*Primary Examiner* — Truc Nguyen
(74) *Attorney, Agent, or Firm* — Sughrue Mion, PLLC

(57) ABSTRACT

Disclosed is a crimp terminal (1) provided with a conductor crimp unit (3A) that has a base (4) and a swage unit (5), which extends from the sides of the base (4) and swages in such a manner that a conductor (20) on the base (4) is crimped. Circular serrations (10*a*, 10*b*) are multiply provided to the inner surface of the conductor crimp unit (3A). The serrations (10*a*, 10*b*) have different sizes according to region.

2 Claims, 8 Drawing Sheets

(56) References Cited

FOREIGN PATENT DOCUMENTS

| | | | |
|---|---|---|---|
| JP | H02-503726 | | 11/1988 |
| JP | 2009-117039 | A | 5/2009 |
| JP | 2009-117085 | A | 5/2009 |
| JP | 2009-170217 | A | 7/2009 |
| JP | 2009-245695 | A | 10/2009 |
| JP | 2009-245699 | A | 10/2009 |
| JP | 2009-259532 | A | 11/2009 |
| JP | 2010-003467 | A | 1/2010 |
| JP | 2010-010001 | A | 1/2010 |
| JP | 2010-27464 | A | 2/2010 |
| JP | 2010-61870 | A | 3/2010 |

OTHER PUBLICATIONS

European Office Action dated Dec. 9, 2013, issued in counterpart European Application No. 11 81 4675.2.

Communication dated Aug. 27, 2014, from the State Intellectual Property Office of the People's Republic of China in counterpart Chinese Application No. 201180038586.5.

Communication dated Sep. 30, 2014 from the Japanese Patent Office in counterpart application No. 2010-175997.

Communication dated Jan. 29, 2015, issued by the European Patent Office in counterpart European application No. 11 814 675.2.

* cited by examiner (a)

(b)

(a)

(b)

CRIMP TERMINAL

TECHNICAL FIELD

The present invention relates to a crimp terminal to be connected to an electric wire.

BACKGROUND ART

As a conventional crimp terminal, there is the one as disclosed in Patent Literature 1. This crimp terminal 50 is provided with a mating terminal connection unit 51 that performs connection with a mating terminal, and an electric wire crimp unit 52 that crimps an electric wire W as shown in FIG. 1(*a*).

The electric wire crimp unit 52 includes a conductor crimp unit 55 which includes a base 53 and one pair of conductor swage units 54 respectively extended from its both sides, and a skin crimp unit 57 which includes the base 53 and one pair of skin swage units 56 respectively extended from its both sides.

Three linear serrations (lock grooves) 58*a*, 58*b* and 58*c* that respectively extend in a direction (hereinafter, referred to as a width direction) orthogonal to an axial direction of the electric wire W are provided in an inner surface of the conductor crimp unit 55 at positions which are almost equally spaced in the axial direction of the electric wire W, as shown in detail in FIG. 2. Although the three serrations 58*a*, 58*b* and 58*c* are tapered such that endmost parts on their both sides become gradually shallower, depths of other regions are as follows. That is, the serration 58*c* on the side that the electric wire W is to be led out is set such that the depth of the width-direction center is shallower than the depths of the both ends. The other two serrations 58*a* and 58*b* are set deep at any position in the width direction.

In the electric wire W, a skin 61 on its terminal part is stripped off and a conductor 60 is exposed. Then, the conductor 60 part of the electric wire W is crimped by swaging deformation of the one pair of conductor swage units 54 and the skin 61 part is crimped by swaging deformation of the one pair of skin swage units 56, as shown in FIG. 1(*b*).

The conductor 60 within the conductor crimp unit 55 bites into the respective serrations 58*a*, 58*b* and 58*c* by crimping force in the course of swaging of the one pair of conductor swage units 54. Stabilization of contact resistance (improvement in electrical performance) between the conductor 60 and the conductor crimp unit 55, and improvement in tensile strength (improvement in mechanical strength) between the conductor 60 and the conductor crimp unit 55 are promoted by bite of the conductor 60 into the three serrations 58*a*, 58*b* and 58*c*.

Specifically, when the conductor 60 that receives the crimping force in the course of swaging of the one pair of conductor swage units 54 is deformed in accordance with groove shapes of the respective serrations 58*a*, 58*b* and 58*c*, edge parts of the respective serrations 58*a*, 58*b* and 58*c* apply strong pressure locally on the conductor 60. Then, a resistive material such as an oxide generated on a surface of the conductor 60 at a part which has received the strong pressure is removed and a new surface which is excellent in conductivity is formed. Stabilization of contact resistance is promoted by generation of this new surface.

In addition, the conductor 60 that receives the crimping force in the course of swaging of the one pair of conductor swage units 54 is protrudingly deformed in accordance with the groove shapes of the respective serrations 58*a*, 58*b* and 58*c*. The tensile strength is improved by generation of this protruding part. On the other hand, if the conductor 60 is largely and protrudingly deformed, the conductor 60 will be subjected to large shearing damage and hence it is feared that the tensile strength will be conversely weakened. Thus, in the conventional example, at a position where tensile force is concentrated in the conductor crimping unit 55, that is, at the width-direction center of the serration 58*c* on the side 9 that the electric wire W is to be led out, the depth of its width-direction center is set shallowly to reduce shearing damage to the conductor 60 on that part.

CITATION LIST

Patent Literature

[PTL 1]
Japanese Patent Laid-Open No. 2009-245695

SUMMARY OF INVENTION

Technical Problem

However, in the crimp terminal of the conventional example, since the serrations 58*a*, 58*b* and 58*c* provided in the conductor crimp unit 55 are three linear grooves, the total edge length of the serrations 58*a*, 58*b* and 58*c* is short. Therefore, the area of the new surface generated on the conductor 60 is small and stabilization of the contact resistance cannot be surely promoted.

In addition, since the serrations 58*a*, 58*b* and 58*c* provided in the conductor crimp unit 55 are the three linear grooves, the total volume (the groove volume) of the serrations 58*a*, 58*b* and 58*c* is small. Therefore, the biting volume of the conductor 60 into the serrations 58*a*, 58*b* and 58*c* is small. Thus, even if the central part of the serration 58*c* on the side that the electric wire W is to be led out is made shallow so as to promote reduction in the shearing damage, the tensile strength cannot be sufficiently improved.

Thus, the present invention has been made in order to solve the above mentioned problems, and its object is to provide a crimp terminal which can surely promote both stabilization of contact resistance and improvement in tensile strength between it and a conductor.

Solution to Problem

In order to attain the above mentioned object, a first aspect of the present invention is a crimp terminal including a conductor crimp unit having a base, and conductor swage units extended from side parts of the base and swaging so as to crimp a conductor on the base; and many circular serrations provided in inner surfaces of the base and the conductor swage units; wherein in the above configuration, the serrations are different from one another in size depending on areas.

A second aspect of the present invention depending from the first aspect lies in that in the crimp terminal, the serrations are small-sized small serrations and large-sized large serrations; the small serrations are provided in an electric wire lead-out side area of the base and the conductor swage units; and the large serrations are provided in an area on the sides opposite to the electric wire lead-out sides of the base and the conductor swage units.

A third aspect of the present invention depending from the first aspect lies in that in the crimp terminal, the serrations are small-sized small serrations and large-sized large serrations; the small serrations are provided in a width-direction central area of the base and the conductor swage units; and the large serrations are provided on the width-direction leading-end sides of the base and the conductor swage units.

Advantageous Effects of Invention

According to the present invention described in the first aspect to the third aspect, since many circular serrations are provided, the total edge length of the serrations can be made longer than that of the linear serrations and the area of the new surface generated on the conductor at the time of crimping can be made large, stabilization of the contact resistance can be surely promoted. In addition, since many circular serrations are provided, the total internal volume of the serrations can be made larger than that of the linear serrations and the total biting volume of the conductor into the serrations can be made large, the tensile strength can be surely improved. Further, the serration has influence on a deformed state, shearing damage and the like of the conductor depending on its size. Therefore, further stabilization of the contact resistance can be promoted and the tensile strength can be further improved by changing the size of the serration depending on the region of the conductor crimp unit.

BRIEF DESCRIPTION OF THE DRAWINGS

FIG. 1(*b*) is a perspective view of the crimp terminal to which the electric wire has been crimped in the conventional example.

FIG. 3(*a*) is a perspective view of an electric wire and a crimp terminal before the electric wire is crimped, and FIG. 3(*b*) is a development view of a conductor crimp unit of the crimp terminal.

FIG. 5(*a*) is a sectional view taken along a Va-Va line in FIG. 4, and FIG. 5(*b*) is a sectional view taken along a Vb-Vb line in FIG. 4.

FIG. 6(*a*) is a perspective view of an electric wire and a crimp terminal before the electric wire is crimped, and FIG. 6(*b*) is a perspective view of a conductor crimp unit of the crimp terminal.

BEST MODES FOR CARRYING OUT THE INVENTION

In the following, embodiments of the present invention will be described on the basis of the drawings.

First Embodiment

Figure 1:
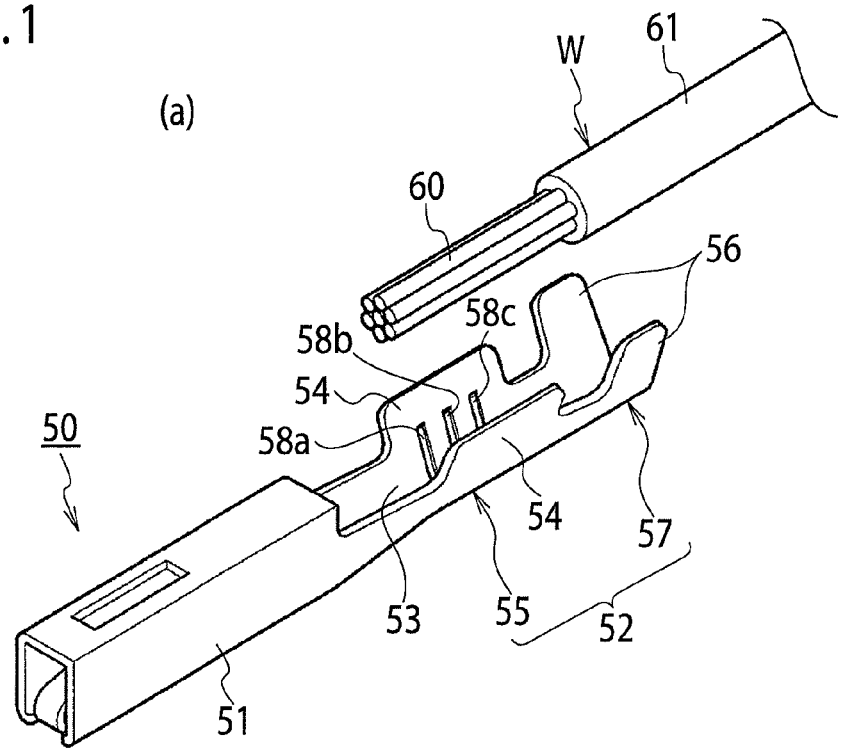
FIG. 1(*a*) is a perspective view of an electric wire and a crimp terminal before the electric wire is crimped in a conventional example.
Figure 1:
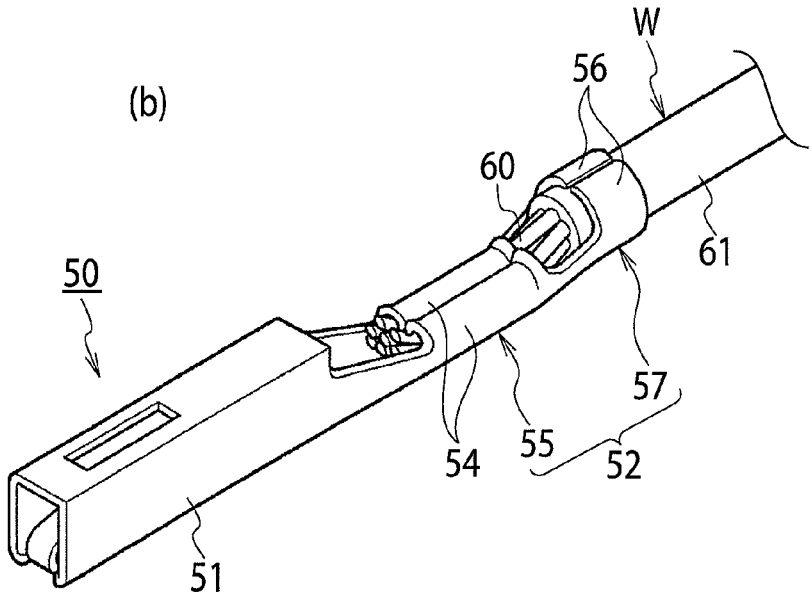
Figure 2:
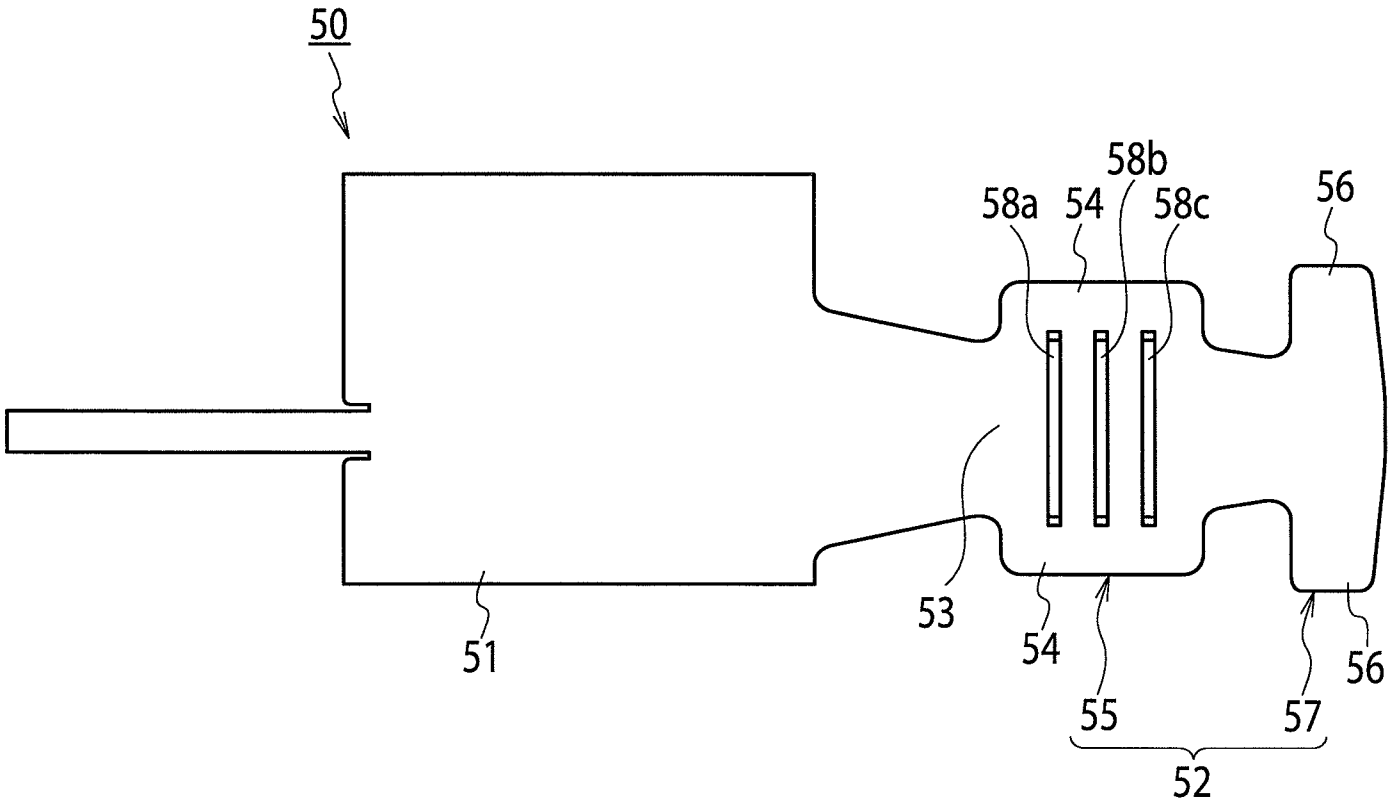
FIG. 2 is a development view of the crimp terminal in the conventional example.
Figure 3:
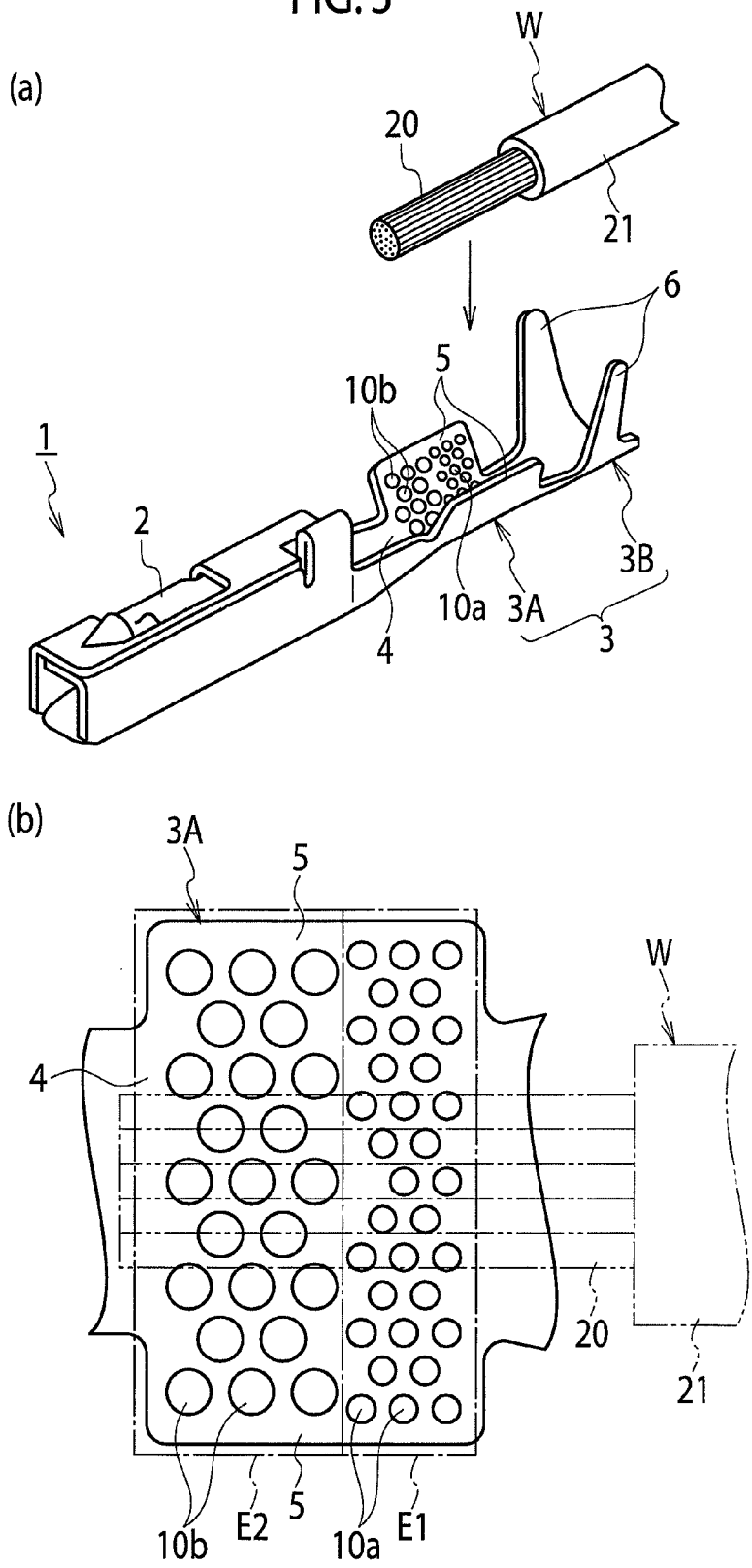
FIG. 3(*a*) and FIG. 3(*b*) show a first embodiment of the present invention.
Figure 5:
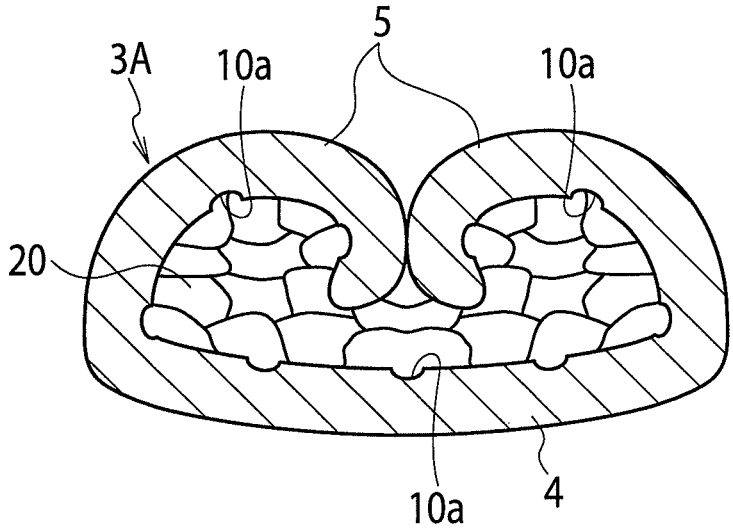
FIG. 5(*a*) and FIG. 5(*b*) show the first embodiment of the present invention.
Figure 5:
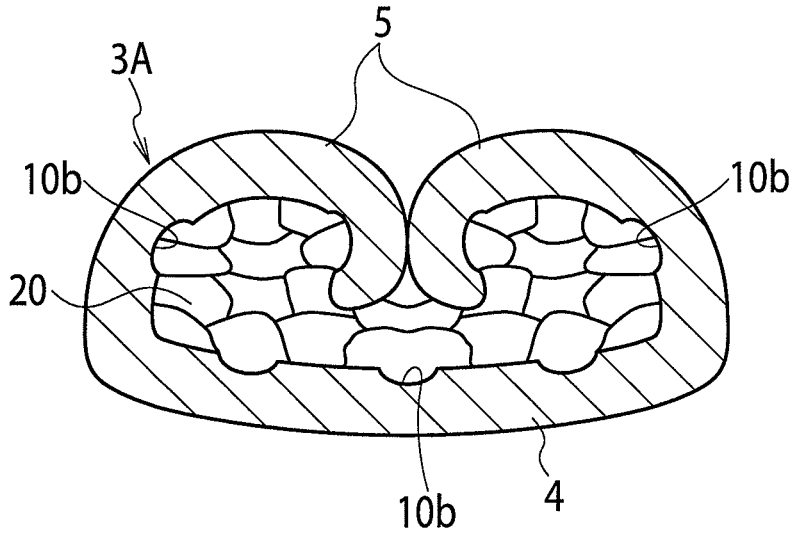

FIG. 3(*a*) to FIG. 5(*b*) show a first embodiment of the present invention. As shown in FIG. 3(*a*), a crimp terminal 1 includes a mating terminal connection unit 2 that performs connection with a mating terminal (not shown), and an electric wire crimp unit 3 that crimps an electric wire W. The crimp terminal 1 is produced by folding a conductive member which has been punched into a predetermined shape.

The mating terminal connection unit 2 has a shape of a square frame body, and has an elastic contact (not shown) inside. The mating terminal (not shown) intrudes into this square frame body and comes into contact with the elastic contact (not shown).

The electric wire crimp unit 3 includes a conductor crimp unit 3A including a base 4 and one pair of conductor swage units 5 which are respectively extended from its both sides, and a skin crimp unit 3B including the base 4 and one pair of skin swage units 6 which are respectively extended from its both sides.

Many circular serrations 10*a* and 10*b* are provided in a scattered state on inner surfaces of the base 4 and the one pair of conductor swage units 5 of the conductor crimp unit 3A, as shown in detail in FIG. 3(*b*). The respective circular serrations 10*a* and 10*b* are grooves which are circularly dented from the inner surfaces of the base 4 and the one pair of conductor swage units 5. The circular serrations 10*a* and 10*b* are two kinds of the small-sized small serrations 10*a* and the large-sized large serrations 10*b*. The small serrations 10*a* and the large serrations 10*b* are dividedly arranged in the inner surfaces of the base 4 and the one pair of conductor swage units 5 depending on regions. That is, the small serrations 10*a* are arranged in an electric wire lead-out side area E1 of the inner surfaces of the base 4 and the one pair of conductor swage units 5. The large serrations 10*b* are arranged in an area E2 on the opposite side of the electric wire lead-out side area of the inner surfaces of the base 4 and the one pair of conductor swage units 5. The small serrations 10*a* and the large serrations 10*b* are scattered respectively at equal intervals.

Figure 4:
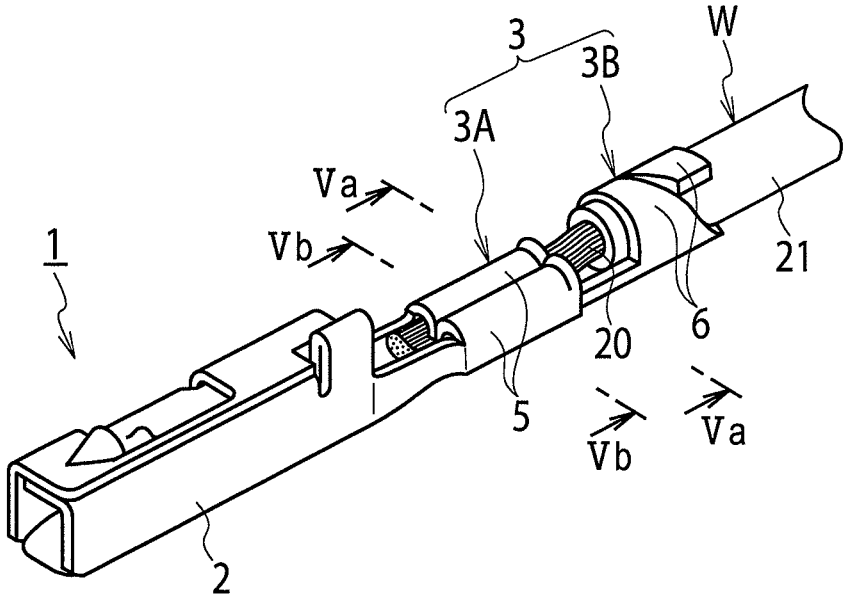
FIG. 4 is a perspective view of the crimp terminal to which the electric wire has been crimped, showing the first embodiment of the present invention.

In the electric wire W, a skin 21 on its terminal part is stripped off and a conductor 20 is exposed. Then, the conductor 20 part of the electric wire W is crimped by the conductor crimp unit 3A with the aid of swaging deformation of the one pair of conductor swage units 5, and the skin 21 part is crimped by the skin crimp unit 3B with the aid of swaging deformation of the one pair of skin swage units 6, as shown in FIG. 4.

The conductor 20 in the conductor crimp unit 3A bites into the small serrations 10*a* and the large serrations 10*b* by crimping force in the course of swaging of the one pair of conductor swage units 5, as shown in FIG. 5(*a*) and FIG. 5(*b*).

As described above, since many circular serrations 10*a* and 10*b* are provided in the inner surfaces of the base 4 and the one pair of conductor swage units 5, the total edge length of the serrations 10*a* and 10*b* is longer than that of the linear serrations in the conventional example, and hence the area of a new surface which will be generated on the conductor 20 at the time of crimping can be increased. Owing to this, stabilization of contact resistance between the conductor crimp unit 3A and the conductor 20 can be surely promoted. In addition, since many circular serrations 10*a* and 10*b* are provided, the total internal volume of the serrations 10*a* and 10*b* can be made larger than that of the linear serrations in the conventional example and the total biting volume of the conductor 20 into the serrations 10*a* and 10*b* is increased, the tensile strength can be surely improved. From the above, both of stabilization of the contact resistance and improvement in tensile strength between it and the conductor 20 can be surely promoted.

Moreover, the serrations 10*a* and 10*b* are two kinds of the small-sized small serrations 10*a* and the large-sized large serrations 10*b*. Then, the small serrations 10*a* are provided in the electric wire lead-out side area E1 of the base 4 and the one pair of conductor swage units 5 as shown in FIG. 5(*a*), and the large serrations 10*b* are provided in the area E2 on the opposite sides of the electric wire lead-out side area of the base 4 and the one pair of conductor swage units 5 as shown in FIG. 5(*b*).

Here, since tensile force acting from the electric wire W to the conductor crimp unit 3A first acts on the electric wire lead-out side of the conductor crimp unit 3A and is received here, the electric wire lead-out side area E1 of the conductor crimp unit 3A is the side where the influence of the tensile strength is large. Since the small serration 10*a* is smaller in shearing damage of the serration edge to the conductor 20 than the large serration 10*b*, a reduction in tensile strength of the electric wire W due to the shearing damage can be prevented in the area E1 of the small serrations 10*a*. In addition, since the large serration 10*b* is longer in total edge length than the small serration 10*a*, the area of the new surface which is generated at the time of crimping is greatly increased in the area E2 of the large serrations 10*b*. Accordingly, the contact resistance is surely stabilized at a low value on the opposite side of the electric wire lead-out side of the conductor crimp unit 3A. From the above, both of stabilization of the contact resistance and improvement in tensile strength between it and the conductor 20 can be surely promoted in this first embodiment.

Second Embodiment

Figure 6:
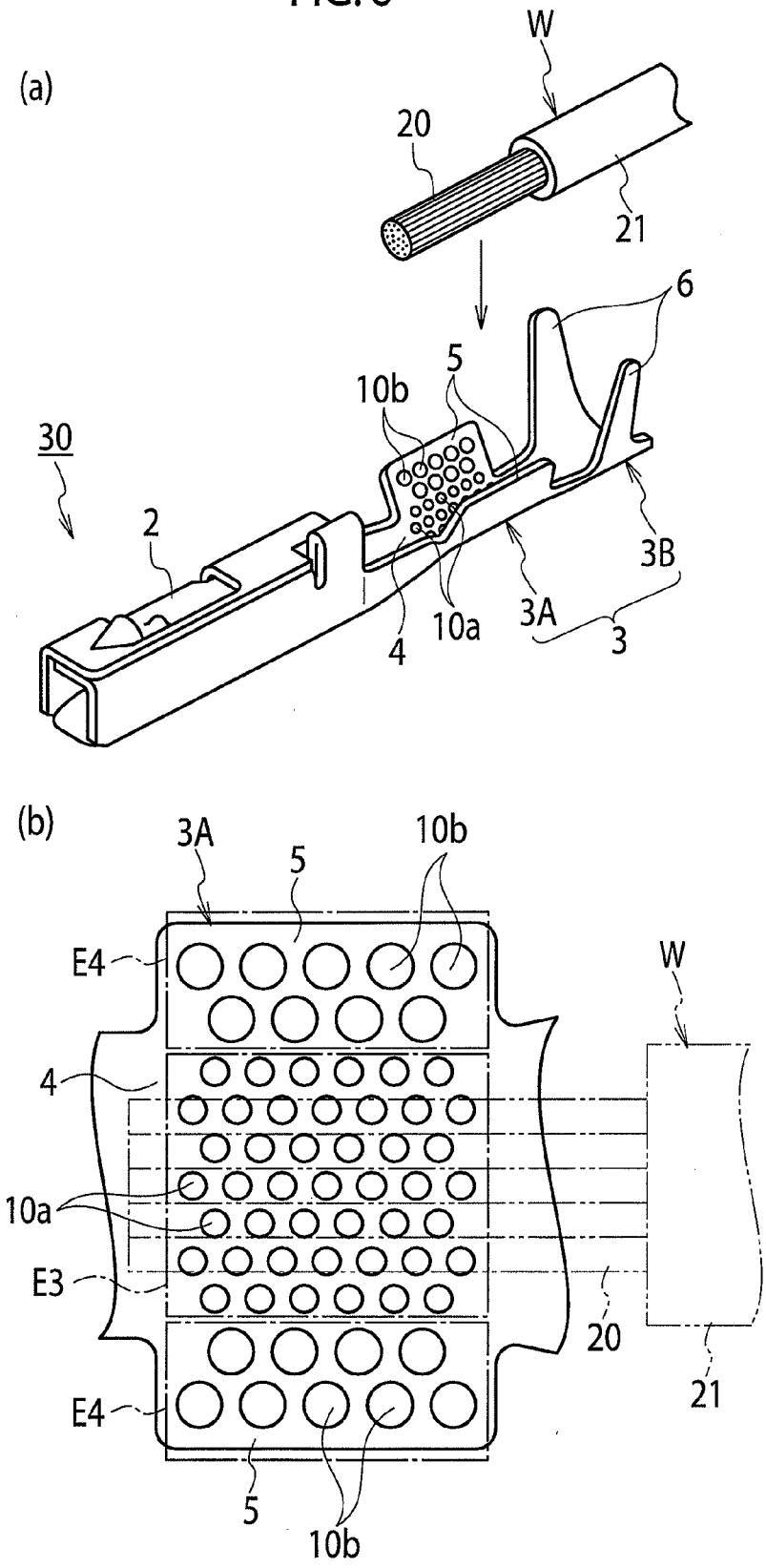
FIG. 6(*a*) and FIG. 6(*b*) show a second embodiment of the present invention.
Figure 7:
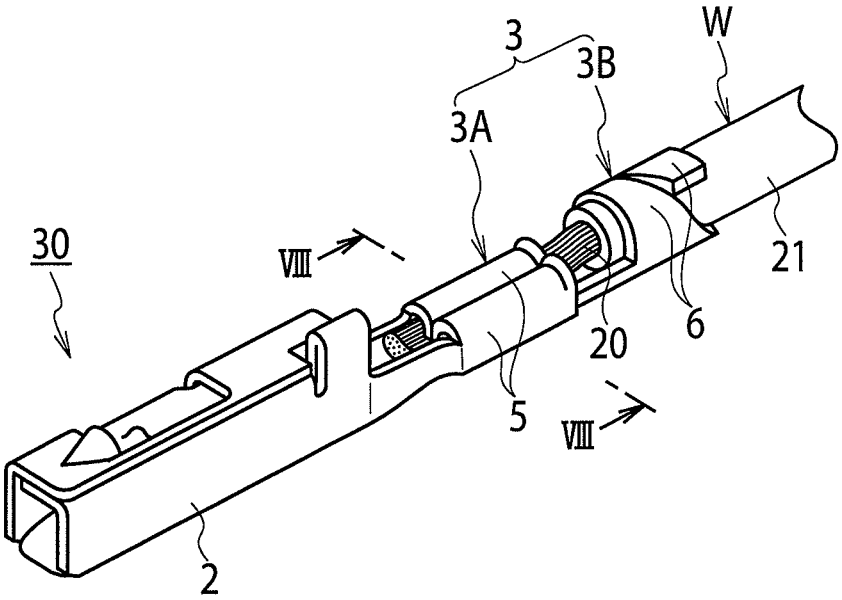
FIG. 7 is a perspective view of the crimp terminal to which the electric wire has been crimped, showing the second embodiment of the present invention.
Figure 8:
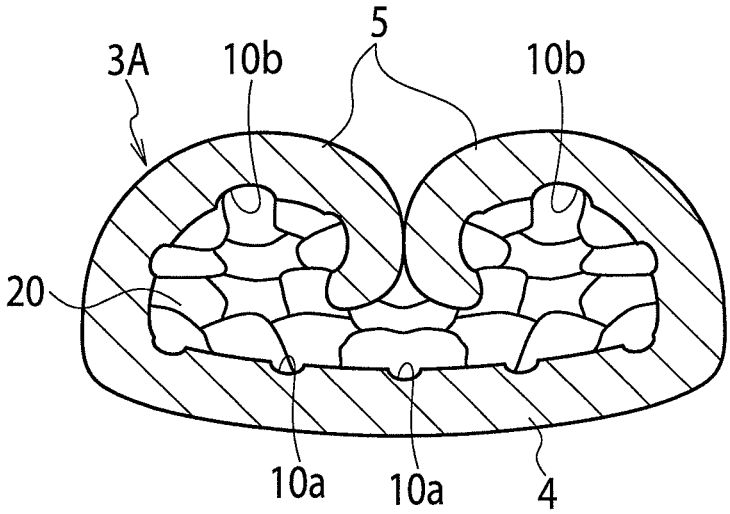
FIG. 8 is a sectional view taken along a VIII-VIII line in FIG. 7, showing the second embodiment of the present invention.

FIG. 6(*a*) to FIG. 8 show a second embodiment of the present invention. A crimp terminal 30 of the second embodiment differs from the one of the first embodiment in regions where the small serrations 10*a* and the large serrations 10*b* are dividedly arranged. That is, as shown in detail in FIG. 6(*b*), the region of the conductor crimp unit 3A is divided into a central area E3 of the conductor crimp unit 3A in a direction (hereinafter, a width direction) orthogonal to the axial direction of the electric wire W, and one pair of width-direction leading-end side areas E4 of the conductor crimp unit 3A. The small serrations 10*a* are arranged in the central area E3, that is, for the most part in the area of the base 4. The large serrations 10*b* are arranged in the one pair of leading-end side areas E4, that is, for the most part in the areas of the one pair of conductor swage units 5. The small serrations 10*a* and the large serrations 10*b* are scattered respectively at equal intervals.

Since other configurations are the same as those in the first embodiment, the same numerals are assigned to the same constitutional parts and description thereof will be omitted.

As described above, since many circular serrations 10*a* and 10*b* are provided in the inner surfaces of the base 4 and the one pair of conductor swage units 5, the total edge length of the serrations 10*a* and 10*b* is longer than that of the linear serrations in the conventional example and hence the area of the new surface to be generated on the conductor 20 at the time of crimping can be made larger. Owing to this, stabilization of the contact resistance between the conductor crimp unit 3A and the conductor 20 can be surely promoted. In addition, since many circular serrations 10*a* and 10*b* are provided, the total internal volume of the serrations 10*a* and 10*b* can be made larger than that of the linear serrations in the conventional example and the total biting volume of the serrations 10*a* and 10*b* into the conductor 20 is increased, the tensile strength can be surely improved. From the above, both of stabilization of the contact resistance and improvement in tensile strength between it and the conductor 20 can be surely promoted.

Moreover, in this second embodiment, the small serrations 10*a* are provided in the width-direction central area E3 of the conductor crimp unit 3A, and the large serrations 10*b* are provided on the width-direction leading-end side of the conductor crimp unit 3A.

Here, in general, bite of the conductor 20 into the serrations is not smooth on the conductor swage unit 5 side at the time of crimping of the conductor crimp unit 3A, and it is feared that a contact pressure at its serration edge will be reduced, the new surface will be broken due to distortion error caused by a difference in linear expansion coefficient between the conductor 20 and tinning induced by thermal shock, and the contact resistance will be varied. However, in the second embodiment, since the large serrations 10*b* are provided in that part, the contact pressure at the serration edge can be maintained. Thus, since the area of the new surface which will be broken by thermal shock can be maximally reduced, a contact resistance value can be stabilized.

In addition, if a space is present between the conductor 20 and the serration at the time of crimping, an oxide film will be generated, and the oxide film will also grow on a part where the new surfaces are in contact with each other, by which it is feared that the contact resistance will be varied. However, since the small serrations 10*a* are provided in the base 4, the space which would be generated between the conductor 20 and the bottom of the serration can be maximally reduced at the time of crimping. Therefore, generation and growth of the oxide film can be suppressed, by which the contact resistance can be stabilized. Owing to the above, the contact resistance can be surely stabilized.

Third Embodiment

Although two embodiments that stabilization of the contact resistance and improvement in tensile strength are further promoted by utilizing that the deformed state, the shearing damage and the like of the conductor 20 can be controlled depending on the size of the serration have been described in the first and second embodiments, patterns other than the above are conceivable.

In addition, the sizes of the serrations may be three or more kinds instead of two kinds. It is desirable to finely set the regions where the serrations are dividedly arranged in accordance with the number of sizes of the serrations.

The circular shape of the small serrations 10*a* and the large serrations 10*b* includes a full-orbed shape and shapes similar to this. In addition, the shapes may be made different from each other depending on the small serrations 10*a* and the large serrations 10*b*.

Incidentally, the full contents of Japanese Patent Application No. 2010-175997 (filed on Aug. 5, 2010) are incorporated into the specification of the present application by reference.

The present invention is not limited to the above mentioned descriptions of the embodiments of the invention and may be embodied in various other modes by performing appropriate modification.

The invention claimed is:

1. A crimp terminal, comprising:

a conductor crimp unit having a base, and conductor swage units extended from side parts of the base and swaging so as to crimp a conductor on the base; and many circular serrations provided on each of inner surface of the base and inner surface of the conductor swage units;

wherein the serrations are different from one another in size depending on areas;

the serrations are small-sized small serrations and large-sized large serrations;

the small serrations are provided in an electric wire lead-out side area of the base and the conductor swage units; and the large serrations are provided in an area on the opposite side of the electric wire lead-out side area of the base and the conductor swage units.

2. A crimp terminal, comprising:

a conductor crimp unit having a base, and conductor swage units extended from side parts of the base and swaging so as to crimp a conductor on the base: and many circular serrations provided on each of inner surface of the base and inner surface of the conductor swage units;

wherein the serrations are different from one another in size depending on areas;

the serrations are small-sized small serrations and large-sized large serrations;

the small serrations are provided in a width-direction central area of the base and the conductor swage units;

the large serrations are provided on the width-direction leading-end sides of the base and the conductor swage units; and the width-direction leading-end sides are directly adjacent the width-direction central area in the width-direction of the crimp terminal.

* * * * *